United States Patent [19]

Tanahashi et al.

[11] Patent Number: 4,635,360

[45] Date of Patent: Jan. 13, 1987

[54] CUTTING HEAD FOR AN ELECTRIC SHAVER

[75] Inventors: Masao Tanahashi; Tetsuo Hamashima; Humihiro Kumano, all of Hikone, Japan

[73] Assignee: Matsushita Electric Works, Ltd., Japan

[21] Appl. No.: 729,219

[22] Filed: May 1, 1985

[30] Foreign Application Priority Data

May 23, 1984 [JP] Japan ..... 59-105152

[51] Int. Cl.[4] ..... B26B 19/14

[52] U.S. Cl. ..... 30/34.2; 30/43.6

[58] Field of Search ..... 30/34.2, 43.92, 43.6

[56] References Cited

U.S. PATENT DOCUMENTS

| | | | |
|---|---|---|---|
| 2,297,915 | 10/1942 | Rand | 30/34.2 |
| 2,824,367 | 2/1958 | McWilliams | 30/34.2 |
| 3,092,904 | 6/1963 | Bruecker | 30/43.92 |
| 3,526,959 | 9/1970 | Young | 30/43.6 |
| 3,579,824 | 5/1971 | Matsumoto et al. | 30/43.92 |
| 3,648,367 | 3/1972 | Tolmie | 30/43.92 |
| 3,890,709 | 6/1975 | Tietjens | 30/43.6 |
| 4,081,902 | 4/1978 | Locke | 30/43.92 |

FOREIGN PATENT DOCUMENTS

| | | |
|---|---|---|
| 1034511 | 12/1958 | Fed. Rep. of Germany . |
| 58-68267 | 5/1983 | Japan . |

*Primary Examiner*—Jimmy C. Peters

*Attorney, Agent, or Firm*—Stevens, Davis, Miller & Mosher

[57] ABSTRACT

A cutter head for an electric shaver comprises an outer shearing foil provided with a series of hair entrance slots arranged in a row. Cooperating with the outer shearing foil is an inner cutter assembly which includes at least one inner blade having a cutting edge elongated in a general direction of the length of each slot and is driven to move in relation to the shearing foil so that the cutting edge is in hair shearing relation with the row of the slots. Formed with the inner blade is a hair scooping projection which projects in a general direction of the movement of the cutting edge and define a sloping edge extending downwardly and outwardly from the cutting edge such that a long hair strands entering the slots can, as the inner blade advances, be slid or guide along the sloping edge up to the cutting edge where the strand is successfully sheared against the edge of the slot. The cutting edge is dimensioned to have its longitudinal ends positioned within the length of each slot so that the cutting edge is not in sliding engagement with the portion of the outer shearing foil other than the webs separating the adjacent slots. Accordingly, the resistance between the cutting edge and the shearing foil is reduced to enable a smooth shearing operation at a minimum power requirement. Also, the hair scooping projection proceeds along the row of the slots in advance of the cutting edge upon the movement of the inner blade in such a way as to straddle across the adjacent webs on both sides of each slot, thus preventing the cutting edge from falling into the slot.

5 Claims, 19 Drawing Figures

CUTTING HEAD FOR AN ELECTRIC SHAVER

BACKGROUND OF THE INVENTION

1. Field of the Invention

The present invention is directed to a cutting head for an electric shaver, and more particularly to a cutting head designed for effectively shearing long or fuzzy hairs 2. Description of the Prior Art For attaining effective shearing of long or fuzzy hairs there have been provided cutting heads which utilize a hair scooping projection added to an inner blade in hair shearing relation with an outer shearing foil. Typical example of the cutting head with the above hair scooping projections is disclosed, for example, in Japanese Utility Model early publication (KOKAI) of application No. 58-68267 published on May 10, 1983, and German Pat. No. 1034511. In the prior devices, as exemplarily shown in FIGS. 1 and 2 of the attached drawings, an outer shearing foil 1 for use in an electric shaver of rotary type cooperates with inner blades 3 for shearing hairs entering the apertures 2 in the outer foil 1. Each of the inner blades 3 is provided at of its one end with hair scooping projection 4 which projects in the general direction of movement of the inner blade 3 and which has at its upper end a sloping edge 5 extending from the cutting edge 6 of the inner blade 3 downwardly and outwardly away from the outer shearing foil 1. The hair scooping projection 4 moves along a particular series of the apertures 2 in spaced relation therebelow as the inner blade 3 is driven so that a long hair strand H entering deep through the apertures 2 in that particular series is entrapped by the projection 4 and is guided or slid along the sloping edge 5 upon movement of the inner blade 3 up to the cutting edge 6 at the upper end of the inner blade 3 where it is successfully sheared against the peripheral edge of the aperture 2. Thus, long hairs can be cut to short hairs which are successively sheared by the cooperation of the inner blade 3 with the other apertures in the outer shearing foil 1 during a continuous manipulation of moving the cutter head across the skin of the user, providing a rapid shaving operation. However, in the above prior device, the cutting edge 6 cooperating with said hair scooping projection 4 is in sliding contact not only with the row in which the above particular apertures 2 are arranged but also with a rib 7 separating that row from the other perforated section of the outer shearing foil 1, rendering the device vulnerable to suffer from an increased resistive load.

Another prior cutting head designed for shearing long hair is exemplarily shown in FIGS. 3 to 5, which is of the rotary type and comprises a stationary cutter 10 formed with an inverted U-shaped channel 11 having a series of circumferentially spaced and generally radial slots 12 each extending into the opposite sidewalls of the channel 11. Placed within the channel 11 are inner blades 13 which are biased upwardly by a spring 14 for shearing engagement with the channel 11. The slots 12 are elongated in a generally radial direction but angled with respect to the cutting edge of the inner blade 13 so that the cutting edge progresses along the longitudinal edge of each slot 12 at an optimum shearing angle. With this construction, long hair can be smoothly fed or combed into the channel 11 through the openings in the sidewall thereof so as to be successfully sheared between the inner blade 13 and the channel 11. In this prior cutting head, however, spacings should be required between the longitudinal ends of the inner blade 13 and the opposed sidewalls of the channel 11 in order to compensate for unintended axial misalignment between the inner blade 13 and the stationary cutter 10 due to possible eccentricity of an inner blade assembly or an output rotor shaft connected to an inner cutter assembly carrying the inner blade 13 with respect to the stationary cutter 10. In view of said spacing required in the above device a problem occurs that a long hair strand H combed into the channel 11 is likely to tangle with the opposite sides of the inner blade 14 to be pulled thereby, as shown in FIG. 4, thus adversely affecting the shearing operation and irritating the user.

Another problem concerned with the above device is that a part of the cutting edge of the inner blade 13 may sometimes fall into the slot 12 in the channel 11, as shown in FIG. 5, producing a loud noise due to the excessive engagement between the channel 11 and the cutting edge and further interrupting the motion of the inner blade 13 in extreme condition. That is, when considering that the requirement of giving enough mechanical strength to the stationary cutter 10 of the above type limits the length X of the channel 10 and correspondingly the length Y of the cutting edge of the cooperating inner blade 13 which is oriented at the optimum shearing angle with respect to the length of each slot 12, an index L/Y indicating the risk of the inner blade 13 falling into the slot 12 becomes a large value, where L is an effective length of a segment of the cutting edge appearing in the slot 12 at the optimum shearing angle with respect to the edge of each slot 12, as shown in FIG. 3. Accordingly, the inner blade 13 with less thickness is more likely to suffer from the unacceptable falling of the inner blade 13. If, on the other hand, the inner blade 13 be formed to have a greater thickness T enough for avoiding the above falling of the inner blade 13, the engaging surface of the inner blade 13 with the stationary cutter 10 would be correspondingly increased to thereby unduly increase the resistive load.

SUMMARY OF THE INVENTION

The present invention has been accomplished with a view to overcoming the above problems and therefore has its primary object to provide a cutting head for an electric shaver which is capable of effectively shearing long hair while reducing the resistive load.

The cutter head in accordance with the present invention comprises an outer shearing foil provided with a series of hair entrance slots arranged in a row and spaced by webs from one another and an inner cutter assembly including at least one inner blade having a cutting edge elongated in a general direction of the length of the slot. The inner cutter assembly is driven to move in relation to the stationary outer shearing foil so that the cutting edge of the inner blade is in hair shearing relation with the row of the hair entrance slots of the outer shearing foil. Said slots are elongated in a direction generally perpendicular to the movement of the cutting edge and spaced from one another in generally parallel relation with the longitudinal dimension of each slot. Formed with the inner blade is a hair scooping projection which projects in the general direction of the movement of the cutting edge and defines at its upper edge a sloping edge extending downwardly and outwardly from the cutting edge such that the spacing between the sloping edge of the projection and the outer shearing foil is greater toward the distal end of the sloping edge than at the juncture with the cutting edge, whereby a long hair strand entering the slots can, as the inner blade advances, be slid or guide along the sloping edge up to the cutting edge where it is successfully sheared against the edge of the slot. Said cutting edge is dimensioned to have its longitudinal ends positioned within the length of each slot so that the cutting edge is not in sliding engagement with the portion of the outer shearing foil other than the webs separating the adjacent slots. This eliminates the sliding or contacting engagement between the cutting blade and the portion of the outer foil separating the above row of slots from other perforated section of the outer shearing foil, thus reducing the resistive load during the shaving operation and enabling a smooth shearing operation at a minimum power requirement. Said hair scooping projection projecting in a generally direction of the movement of the inner blade moves along the row of slots in advance of the cutting edge in such a way as to straddle across the adjacent webs on both sides of each slot, thus serving as a stop by which the cutting edge can be prevented from entering or falling into the slot.

Accordingly, it is a primary object of the present invention to provide a cutter head for an electric shaver which is capable of effectively shearing long hair, yet reducing the resistive load as well as preventing the accidental falling of the inner blade into the slot of the outer shearing foil.

In a preferred embodiment, the outer shearing foil is formed of circular configuration for use in an rotary electric shaver. The circular shearing foil is provided in its peripheral portion with an annular groove which defines outwardly thereof said row of hair entrance slots. Each of the slots is configured to & extend into the adjacent sidewall of the groove to define thereat a generally vertical opening which facilitates the feeding of the long or fuzzy hair strands into the slot, thus smoothly combing these hair strands into the slots for an effective shearing purpose.

It is therefore another object of the present invention to provide a cutter head for an electric shaver which is capable of easily and effectively combing the long or fuzzy hairs into the slots.

In another preferred embodiment, the circular outer shearing foil is formed along the periphery thereof with a depending outer wall in adjacent relation with said row of hair entrance slots arranged in a circle inwardly of the depending outer wall. Each of the slots in the circular row is configured to extend into the depending outer wall so as to define thereat a generally vertical opening through which the long or fuzzy hairs can be easily combed into the slots. Said hair scooping projection is formed on the one end of the inner blade adjacent the depending outer wall so as to effectively catch and shear the hair entering through the vertical opening, thus further improving a shearing operation, which is also an object of the present invention.

The outer shearing foil in the present invention has first and second sections separated by a rib. The first section is provided with a plurality of hair entrance apertures for shearing short hair and the second section is provided with said row of hair entrance slots for shearing long or fuzzy hair. The inner cutter assembly includes separate inner blades, one with a cutter edge in shearing relation with the apertures in the first section, and the other with said cutting edge with said hair scooping projection, which cutting edge is in shearing relation with the slots in the second section of the outer shearing foil. Alternatively, the inner cutter assembly includes at least one inner blade having both of the above cutter edge and the cutting edge, which edges are separated by a recess formed in that inner blade. With this construction, the rib separating the first section from the second section can be prevented from engaging the cutting edge for the attaining the above purpose.

In the present invention, there are disclosed other advantageous features including a particular construction for an electric shaver of reciprocatory type in which the hair scooping projections are formed on both side of each reciprocating inner blade.

These and still other advantageous and useful arrangements will become more apparent from the following description of the preferred embodiment when taking in conjunction with the accompanying drawings.

BRIEF DESCRIPTION OF THE DRAWINGS

FIG. 17 is a sectional view of the part of a cutter head in accordance with a fourth embodiment of the present invention; and FIG. 18 is a partial top view of the cutter head of FIG. 17.

DESCRIPTION OF THE PREFERRED EMBODIMENTS

Figure 1:
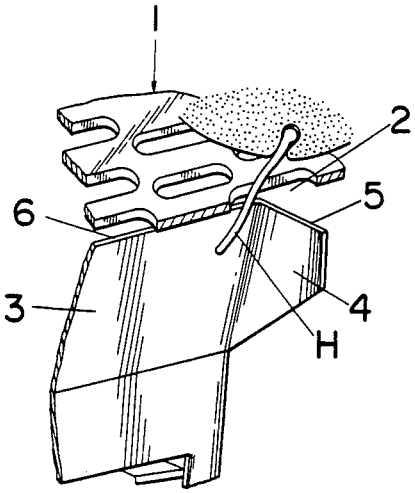
FIG. 1 is an enlarged partial view in perspective representation, of a shearing relation of an inner blade with an outer shearing foil of a prior cutting head for an electric shaver.
Figure 2:
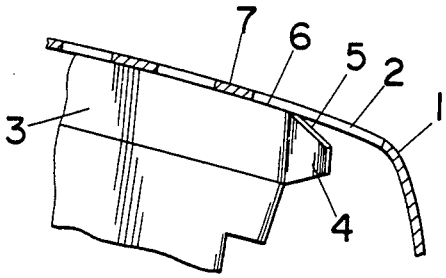
FIG. 2 is a partial sectional view of the above cutting head.
Figure 3:
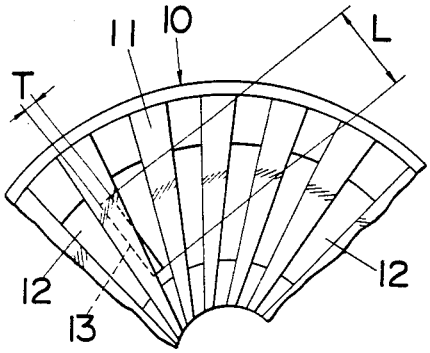
FIG. 3 is a partial top view of another prior cutting head.
Figure 4:
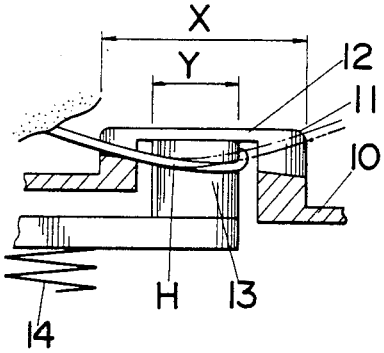
FIGS. 4 and 5 are sectional views respectively illustrating shearing relations of an inner blade with a cooperative stationary outer cutter of the cutter head of FIG. 3.
Figure 5:
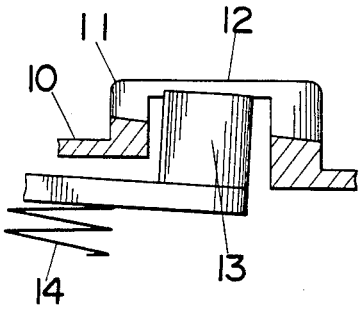

Referring now to FIG. 6 to 11, there is shown a cutting head for an electric shaver of rotary type in accordance with a first embodiment of the present invention. The cutting head comprises a circular outer shearing foil 20 and an inner cutter assembly 40 carrying a plurality of inner blades 41 and 42. The outer shearing foil 20 is supported by means of a sleeve ring 21 on a frame 22 which has its lower portion threaded at 23 for being mounted on a housing (not shown) of the electric shaver. Extending interiorly of the peripheral portion of the outer shearing foil 20 is a comb ring 24 which has its upper portion being in intimate contact with the outer shearing foil 20 for reinforcing the peripheral portion thereof, the upper portion of the comb ring 24 is divided to form thereat a plurality of slits 25 which are in open communication with slots formed in the peripheral portion of the outer shearing foil 20.

Figure 6:
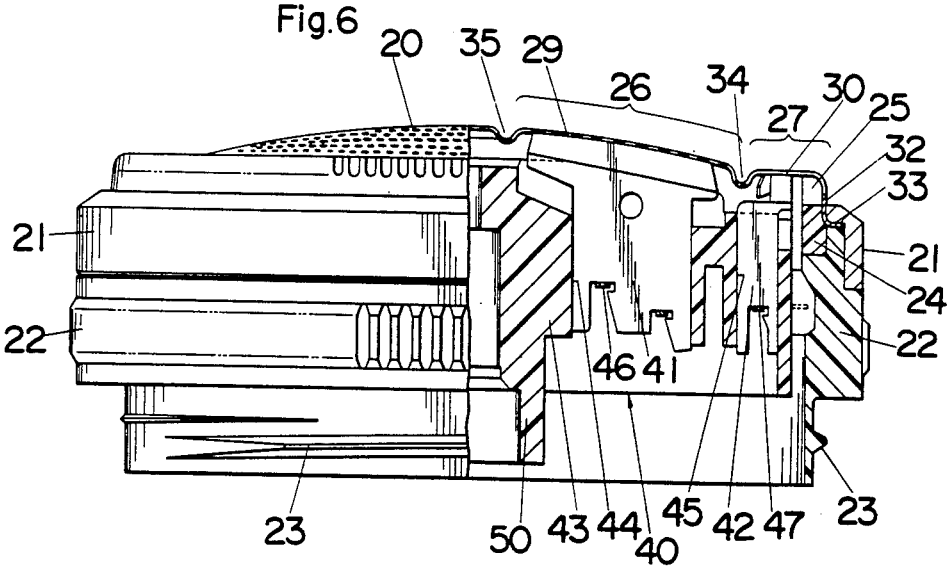
FIG. 6 is a front elevation, partly in cross section, of a cutter head for an electric shaver in accordance with a first embodiment of the present invention.
Figure 7:
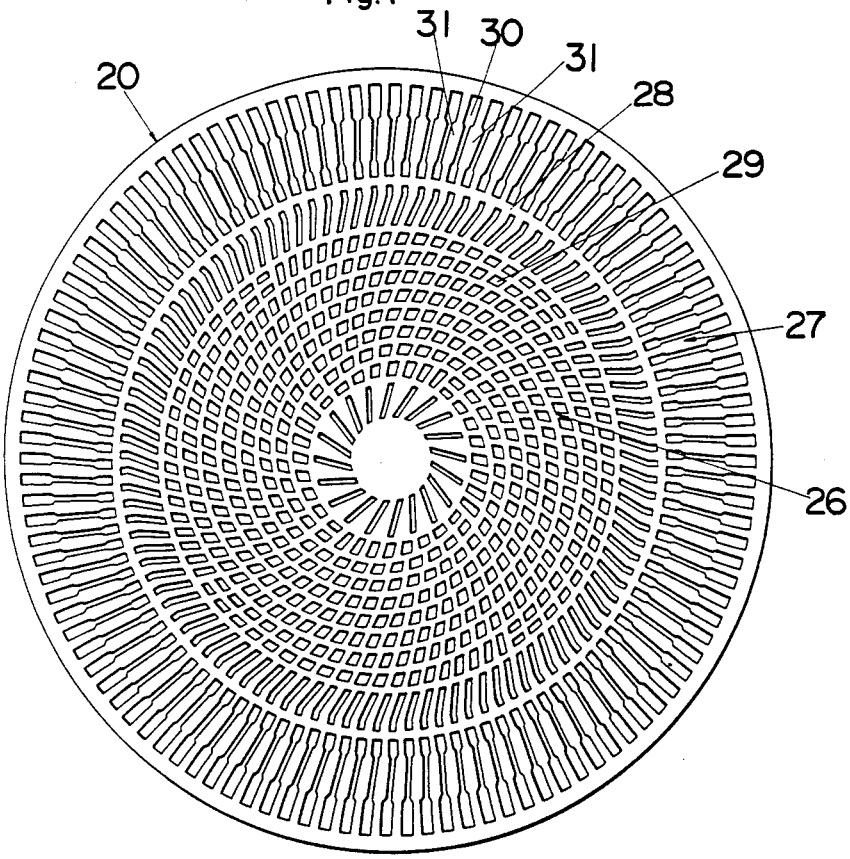
FIG. 7 is a top view of an outer shearing foil employed in the above cutting head of FIG. 6.
Figure 9:
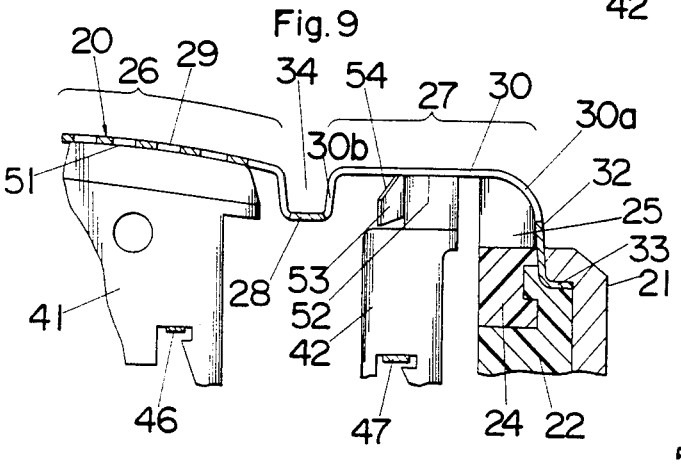
FIG. 9 is an enlarged sectional view of a part of the above cutting head illustrating the shearing relation between the outer shearing foil and an inner blade with a hair scooping projection.

The outer shearing foil 20 is divided into first and second sections 26 and 27 which have respective patterns of hair entrance openings arranged about an center axis of the foil 20 and separated by an annular rib 28 extending in the peripheral portion thereof. The first section 26 defined inwardly of the rib 28 is formed with a plurality of hair entrance apertures 29 distributed substantially throughout the area thereof for shearing relatively short hair strands. The second section 27 defined outwardly of the rib 28 is formed with a series of generally radially oriented slots 30 for shearing relatively long hair strands or fuzzy hair strands. These slots 30 are arranged along a circle concentric with the axis and evenly spaced circumferentially by webs 31 from one another in a generally parallel relation with the longitudinal dimension of each slot 30. The outer shearing foil 20 is also provided at its periphery with a depending outer wall 32, the lower end of which is turned outwardly to form thereat a flange 33 to be held between the sleeve ring 21 and the frame 22. As best shown in FIGS. 6 and 9, said rib 28 is formed into a U-shaped member with opposite sidewalls defining therebetween an annular groove 34, one of the sidewalls cooperating with the second section 27 including the depending outer wall 32 to configure that section 27 into a generally inverted U-shape channel with said hair entrance slots 30. Each of the slots 30 extends into both the depending wall 32 and the adjacent sidewall of the groove 34 to form thereat generally vertical openings respectively for smoothly combing hairs, particularly long or fuzzy hairs into the channel of the second section 27. It is noted at this time that the apertures 29 lying adjacently along the annular groove 34 also extend into the other sidewall of the groove 34 to likewise form generally vertical openings for a long or fuzzy hair combing purpose. Another annular groove 35 of short diameter is formed in the first section 26 about the center axis of the outer shearing foil 20.

Figure 8:
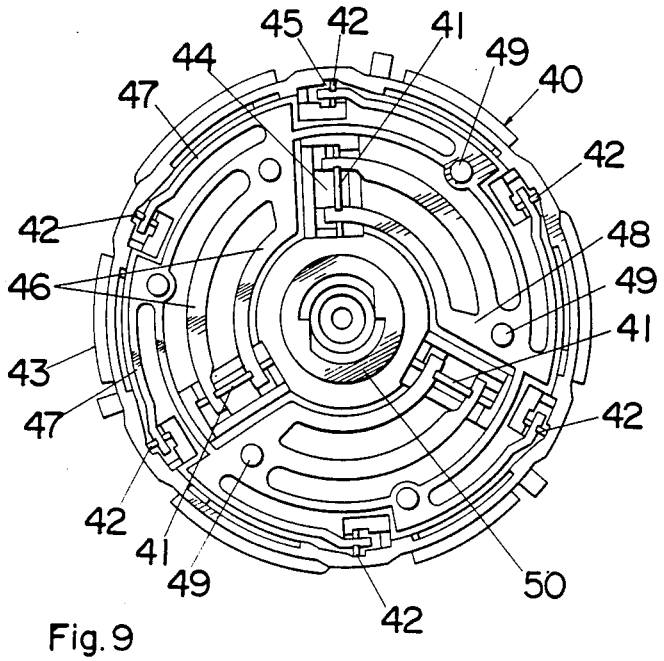
FIG. 8 is a bottom view of an inner cutter assembly employed in the above cutting head.

Said inner cutter assembly 40 positioned below the outer shearing foil 20 includes an assembly base 43 on which first and second inner blades 41 and 42 are mounted with their legs inserted into corresponding ports 44 and 45 in the base 43, these legs being engaged with free ends of complementary spring arms 46 and 47 for urging the inner blades 41 and 42 for hair shearing relation with the outer shearing foil 20. These springs arms 46 and 47 are struck from and formed integrally with a thin metal plate 48 which is disposed on the undersurface of the assembly base 43 and heat sealed thereto at respective portions 49 corresponding to supported ends of the spring arms 46 and 47, as shown in FIG. 8. Integrally extending downwardly from the center of the assembly base 43 is a hub 50 into which an output shaft (not shown) of an electric motor extends for driving the inner cutter assembly 40 to rotate about its axis with respect to the stationary outer shearing foil 20.

Each of the first inner blades 41 defines a cutter edge 51 which is elongated in a radial direction so as to be in hair shearing relation with the apertures 29 of the first section 26 of the outer shearing foil 20 for shearing the hairs entering the apertures 29 upon rotation of the inner cutter assembly 40. Each of the second inner blades 42 defines a cutting edge 52 of less radial dimension relative to the above cutter edge 51 for hair shearing relation with said row of slots 30 in the second section 27 of the outer shearing foil 20 for shearing the hairs entering the slots 30 upon the rotation of the inner cutter assembly 40. The length of each cutting edge 52 is dimensioned so that the cutting edge 52 has its both ends within the length of the each slot 30. In other words, each cutting edge 52 is so configured that it is in sliding engagement only with the row of slots 30 or the webs 31 separating the adjacent slots 30 and is never in sliding engagement with said rib 28 separating the second section 27 from the first section 26 of the outer shearing foil 20, thus reducing the resistive load in driving the inner cutter assembly 40.

The cutting edge 52 is oriented generally in a radially direction and is so angled with respect to the length of each slot 30 that the edge 52 advances upon rotation of the inner blade assembly 40 at an optimum shearing angle with the lengthwise edge of each slot 30. In this embodiment, a total of six second inner blades 42 is mounted on the peripheral portion of the assembly base 43 to be angularly spaced at regular intervals with each alternate one being substantially in a radial alignment with each of three in number of the first inner blades 41, as shown in FIG. 8.

Figure 10:
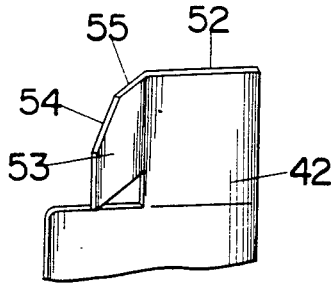
FIG. 10 is an enlarged perspective view of the above inner blade with the hair scooping projection.

A hair scooping projection 53 extends integrally from one of the opposite ends of the second inner blades 42 in a general direction of the movement of the inner blades 42 to define at its upper edge a sloping edge 54 extending outwardly and downwardly such that the spacing between the sloping edge 54 and the outer shearing foil 20 is greater at the distal end than at the juncture with the cutting edge 52. The sloping edge 54 terminates at its upper end in a ledge portion 55 which is level with and joins the cutting edge 52, as best shown in FIG. 10.

Figure 11:
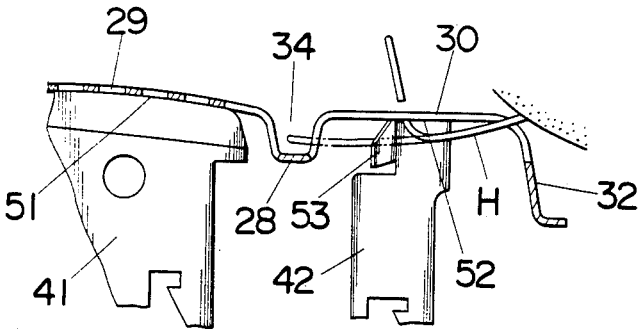
FIG. 11 is an enlarged sectional view illustrating a shearing operation of the above cutter head.

In operation, hairs particularly long hairs or fuzzy hairs are combed into the slots 30 smoothly by the help of either or both of the vertical openings in the depending outer wall 32 and in the adjacent sidewall of the annular groove 34. As shown in FIG. 11, the hair H (indicated by dotted line of the figure) entering the slot 30 but initially failing to reach the cutting edge 52 of each of the second inner blades 42 can be guided upwardly along the sloping edge 54 of the hair scooping projection 53 as the second inner blade 42 moves and be accordingly fed up to the cutting edge 52 where the hair (indicated by solid line of the figure) is successfully sheared against the cutting edge of the slot 30. In this manner, the hairs entering the slots 30 are guided to the cutting edge to be successfully sheared effectively and without being tangled with the second inner blades 42, assuring a comfortable shearing operation without irritating the skin of the user. The shearing by the help of the above hair scooping projection 53 is rather for cutting long hairs to short and therefore short hairs may remain on the skin even after passing through the slots 30, which short hairs are subsequently sheared by the cutter edges 51 of the first inner blades 41 for providing a close shave during a continuous shaving operation of manipulating the cutter head across the skin surface of the user. During the above shearing operation, the cutting edge 52 of each of the second inner blades 42 is kept free from engaging with the portion other than the webs 31 separating the slots 30 from one another, thus reducing the resistive load to enable the shearing operation to take place at a reduced power requirement. Also, with the configuration that the hair scooping projection 53 projects in a general direction of movement of the second inner blade 42, the projection 53 can well serve to bridge over the adjacent webs 31 on opposite sides of each slot 30 as the associated second inner blade 42 advances so as to prevent an accidental falling of the cutting edge 52 into the slot 30 even with the inner blade of less thickness, ensuring the shearing operation at a reduced resistive load as well as at a reduced noise level. In addition, said hair scooping projection 53 can also serve to lessen the chance that the hairs pass through the slot 30 without being entrapped by the second inner blade 42 during the manipulation of moving the cutting head across the skin of the user. Further, in the present embodiment, the second inner blades 42 are separated from the first inner blades 41 so as not to be subjected to the resistance that the first blades 41 suffer during their shearing operation in cooperation with the hair entrance apertures 29 in the first section 26 of the outer shearing foil 20, whereby the second inner blades 42 moving independently of the first inner blades 41 can be rendered to operate in a stable manner for providing maximum shearing efficiency.

Figure 12:
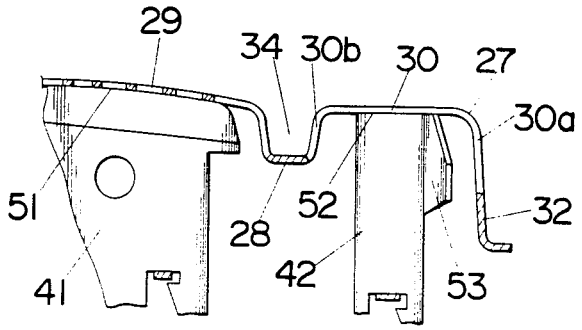
FIG. 12 is an enlarged sectional view of a part of a cutting head illustrating the shearing relation between an inner blade with a hair scooping projection and an outer shearing foil in accordance with a second embodiment of the present invention.
Figure 13A:
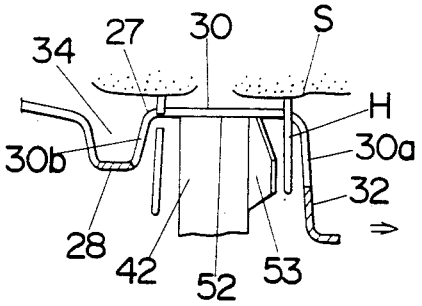
Fig. 13A sectional view illustrating a hair shearing mechanism of the above cutting head.
Figure 13B:
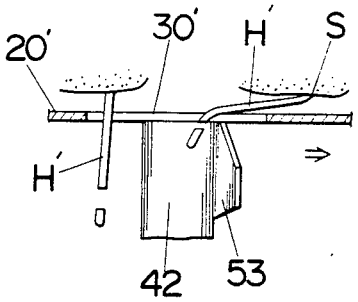
FIG. 13B is a sectional view illustrating a hair shearing mechanism with the use of a flat outer shearing foil introduced for comparison with the mechanism of FIG. 13A.

Referring to FIG. 12, there is illustrated a cutter head in accordance with a second preferred embodiment which is similar in construction to the first embodiment except that a hair scooping projection 53 projects from each of the second inner blades 42 at the one end confronting the depending outer wall 32 of the outer shearing foil 20. The effect of the hair scooping projection 53 is identical to that in the first embodiment. The above provision of each hair scooping projection 53 on the side adjacent the depending outer wall 32 is advantageous in that the projections 53 will move in a closing relation with the vertical opening 30*a* in the depending outer wall 32, serving to decrease the amount of clipped hair ends flowing outwardly of the cutter head through those openings. In connection with the above, the configuration that each of the slots 30 extends into the depending outer wall 32 and the adjacent sidewall of the annular groove 34 to form thereat respectively generally vertical openings 30*a*, 30 *b* can well facilitate the combing action of feeding the hairs into the slots 30 to thereby improve the shearing by the cutting edge 52. That is, with the slot 30 provided in the channel member of the second section 27 and extending into the vertical openings 30*a* and 30*b*, as schematically shown in FIG. 13A, the long hairs H can be readily lifted by the leading edge of the channel-shaped second section 27 of the outer shearing foil 20 as the cutting head moves across the skin S in the direction indicated by an arrow so as to allow upright feeding or combing of the long hairs into the slots 30 for shearing the same. This is in contrast to the case where slots 30' are formed in a planer foil 20', as shown in FIG. 13B. In this case, long hairs H' lying flat against the skin S will hardly be lifted by the surface of the foil 20' and consequently remain flattened as the cutting head advances in the direction of an arrow, only allowing the ends of the long hairs H entering the slots 30' to be sheared and resulting in the failure of effectively shearing the long hairs.

Figure 14:
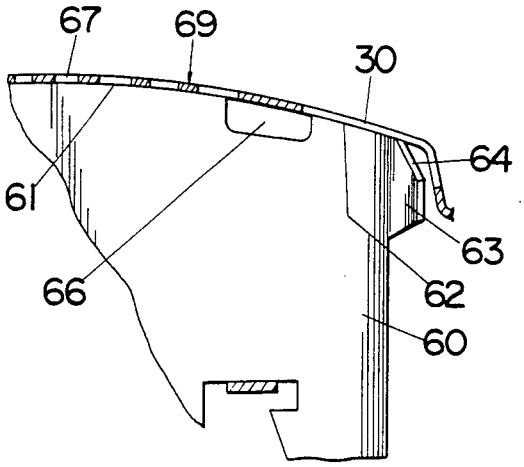
FIG. 14 is a sectional view of the part of a cutter head in accordance with a third embodiment of the present invention.
Figure 15:
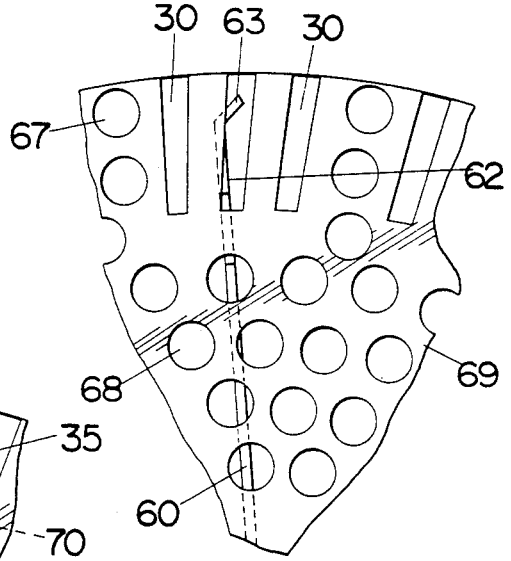
FIG. 15 is a partial top view of the cutter head of FIG. 14.

Referring to FIGS. 14 and 15, there is shown a cutting head in accordance with a third embodiment of the present invention which is similar in construction to the above first embodiment except that an inner cutter assembly carries twin-edge inner blades 60 each formed with a cutter edge 61 and a cutting edge 62 which are separated by a recess 66 and that a series of hair entrance slots 30 are interrupted by rounded holes 67. A hair scooping projection 63 with a sloping edge 64 projects from the radially outer edge of each inner blade 60 so as to cooperate with the cutting edge 62 adjacent thereto for shearing the hairs entering the slots 30 in a like manner as in the previous embodiments. The cutter edge 61 is cooperative with a pattern of circular apertures 68 formed inwardly of the row in which said slots 30 are arranged for providing a close shave. The recess 66 is formed for avoiding the sliding engagement of the cutting edge 62 with the outer shearing foil 69 at the portion other than the annular row along which said slots 30 are arranged, thus enabling the cutter head to be operated at a reduced resistive load in much the same way as in the previous embodiment. The other effects of preventing the tangling of the hairs with the inner blades as well as the falling of the cutting edge into the slots can be also available in this embodiment.

Figure 16:
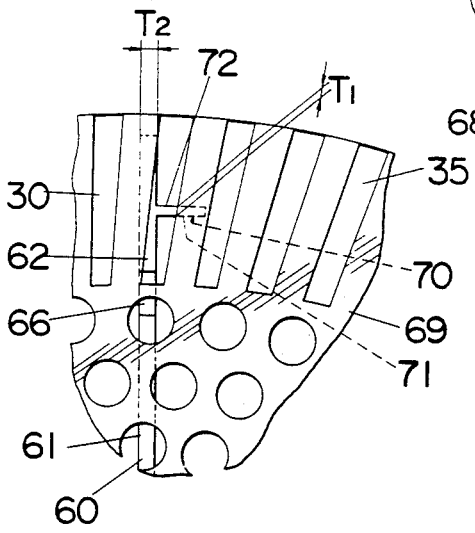
FIG. 16 is a partial top view of a modification of FIGS. 14 and 15.

FIG. 16 shows a modification of the third embodiment of FIGS. 14 and 15 in which a hair scooping projection 70 with a sloping edge 71 projects from each of the inner blade 60 at the portion intermediate the length of the cutting edge 62 in a direction of the movement of the inner blade 60 or at a right angle with respect thereto. With this projection 70 on the intermediate portion of the length of the cutting edge 62, the hairs entering the slots 30 from either of the longitudinal ends thereof can be entrapped by the projection 70 without fail, enhancing the efficiency of shearing operation. In this modification, each of the hair scooping projections 70 has its ledge portion 72 dimensioned to be of thickness $T_1$ less than the thickness $T_2$ of the cutting edge 62, for the purpose of further reducing the resistive load in the operation of the cutter head.

Referring to FIG. 17 and 18, a cutting head in accordance with a fourth embodiment of the present invention is disclosed. The cutting head is designed for an electric shaver of the reciprocating type and comprises an arcuate outer shearing foil 80 and a plurality of arcuate inner blades 90 arranged in parallel relation with one another. The outer shearing foil 80 is formed at its center with a series of laterally extended slots 81 spaced along a row which lies in parallel with the longitudinal axis of the foil 80 and is formed at the portions on both sides of that row with a plurality of rounded apertures 82, which portions are separated from the row of said slot 81 by ribs 83. Each of the inner blades 90 defines a cutting edge 92 and a pair of cutter edges 91 which are separated from the cutting edge 92 respectively by recesses 93, said cutting edge 92 being in hair shearing relation with the row of slots 81 and said cutter edges 91 being in hair shearing relation with the apertures 82 upon reciprocation of the inner blades 90 along the longitudinal axis of the outer shearing foil 80. These recess 93 are formed at the portions corresponding to the above ribs 83 so that the cutting edges 92 are free from engaging the ribs 83 and are only in sliding engagement with the webs separating the slots 81 from one another, thus reducing the resistive load upon the reciprocation of the inner blades 90. Each inner blade 90 is provided on each side of the cutting edge 92 with a hair scooping projection 94 projecting at a right angle thereto. The projections 94 are identical in configuration to those disclosed in the previous embodiments and modification and have a sloping edge 95 along which the hair entering the slot 81 is guided to the adjacent cutting edge where it is sheared against the edge of the slot 81. The provision of the hair scooping projections 94 on both sides of each cutting edge 92 assures the above hair guiding action in either of the reciprocating directions.

What is claimed is:

1. A cutting head for an electric shaver comprising:

an outer shearing foil provided with a series of hair entrance slots arranged in a row and spaced from one another by webs; said outer shearing foil being divided into:

(a) a first radial inner section having a plurality of hair entrance apertures for shearing relatively short hair strands and (b) a second radial outer section having a plurality of hair entrance slots formed as a series of generally radially oriented slots for shearing relatively long hair strands;

an inner cutter assembly including a first radial inner and a second radial outer blade which are separated from each other and mounted on a common assembly base, each blade having a cutting edge elongated in a generally radial direction;

said first inner blade defining a cutting edge which is in hair shearing relation with said hair entrance apertures in the first section of the shearing foil and said second inner blade defining a cutter edge which is in hair shearing relation with said hair entrance slots in the second section of the shearing foil;

means for driving the inner cutter assembly for moving the cutting edges of the first and second inner blades in hair shearing relationship with the rows of the hair entrance slots of the outer shearing foil;

said slots being elongated in the direction generally perpendicular to the movement of the cutting edge and spaced from one another in generally parallel relation with the longitudinal dimension of each slot;

a hair scooping projection extending from the second inner blade in the general direction of the movement of the cutting edge, said hair scooping projection defining a sloping edge which extends downwardly and outwardly from the cutting edge such that the spacing between the sloping edge of the projection and the outer shearing foil is greater toward the distal end of the sloping edge than at the juncture with the cutting edge; the hair scooping projection thus being positioned to straddle across the webs between adjacent slots to prevent the cutting edge from falling into the slots;

said cutting edge of the second inner blade having its longitudinal ends positioned within the length of each slot so that the cutting edge is not in sliding engagement with the portion of the outer shearing foil other than the webs separating the adjacent slots; and, means biasing said first and second inner blades against the first section and the second section respectively of the outer shearing foil, said biasing means being independent of each other.

2. A cutting head as set forth in claim 1, wherein said outer shearing foil is of circular configuration for use in an rotary electric shaver; said outer shearing foil being provided with an annular groove in the peripheral portion thereof which defines outwardly thereof said second radial outer section and row of hair entrance slots; and each of the slots extending into the adjacent sidewall of the groove.

3. A cutting head as set forth in claim 1, wherein said outer shearing foil is of circular configuration for use in a rotary electric shaver; said outer shearing foil being provided in its second radial outer section, along its periphery, with a depending outer wall; said row of hair entrance slots lying along the periphery of the outer shearing foil with each of the slots extending into the depending outer wall.

4. The cutting head of claim 1 in which the hair scooping projection extends from the radial inner portion of the second section of the cutter assembly.

5. The cutting head of claim 1 in which the hair scooping projection extends from the radial outer portion of the second section of the cutter assembly.

* * * * *